US010260133B2

(12) United States Patent
Kawabe et al.

(10) Patent No.: US 10,260,133 B2
(45) Date of Patent: Apr. 16, 2019

(54) HIGH-STRENGTH STEEL SHEET AND METHOD FOR PRODUCING THE SAME

(71) Applicant: JFE STEEL CORPORATION, Tokyo (JP)

(72) Inventors: Hidetaka Kawabe, Chiba (JP); Takeshi Yokota, Tokyo (JP); Reiko Sugihara, Chiba (JP); Kazunori Tahara, Chiba (JP)

(73) Assignee: JFE Steel Corporation, Tokyo (JP)

( * ) Notice: Subject to any disclaimer, the term of this patent is extended or adjusted under 35 U.S.C. 154(b) by 442 days.

(21) Appl. No.: 14/779,783

(22) PCT Filed: Mar. 26, 2014

(86) PCT No.: PCT/JP2014/001730

§ 371 (c)(1),
(2) Date: Sep. 24, 2015

(87) PCT Pub. No.: WO2014/156142

PCT Pub. Date: Oct. 2, 2014

(65) Prior Publication Data

US 2016/0083819 A1 Mar. 24, 2016

(30) Foreign Application Priority Data

Mar. 28, 2013 (JP) ..... 2013-068295

(51) Int. Cl.

| | |
|---|---|
| ***C22C 38/06*** | (2006.01) |
| ***C21D 9/46*** | (2006.01) |
| ***C22C 38/00*** | (2006.01) |
| ***C21D 8/02*** | (2006.01) |
| ***C23C 2/06*** | (2006.01) |
| ***C23C 2/02*** | (2006.01) |
| ***C23C 2/40*** | (2006.01) |
| ***C25D 5/36*** | (2006.01) |
| ***C25D 7/06*** | (2006.01) |
| ***C21D 6/00*** | (2006.01) |
| ***C22C 38/02*** | (2006.01) |
| ***C22C 38/04*** | (2006.01) |
| ***C25D 3/22*** | (2006.01) |
| ***C25D 7/00*** | (2006.01) |
| ***C22C 38/22*** | (2006.01) |

(52) U.S. Cl.

CPC ..... *C22C 38/06* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0247* (2013.01); *C21D 8/0263* (2013.01); *C21D 8/0278* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/22* (2013.01); *C23C 2/02* (2013.01); *C23C 2/06* (2013.01); *C23C 2/40* (2013.01); *C25D 3/22* (2013.01); *C25D 5/36* (2013.01); *C25D 7/00* (2013.01); *C25D 7/0614* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C22C 38/06; C22C 38/00; C21D 9/46; C21D 8/0247; C21D 6/005

See application file for complete search history.

(56) References Cited

U.S. PATENT DOCUMENTS

| | | | | |
|---|---|---|---|---|
| 4,508,600 | A * | 4/1985 | Irie | C25D 3/562 205/155 |
| 2004/0074575 | A1* | 4/2004 | Kashima | C21D 8/0226 148/653 |
| 2011/0146852 | A1 | 6/2011 | Matsuda | |
| 2011/0162762 | A1 | 7/2011 | Matsuda | |
| 2012/0222781 | A1 | 9/2012 | Azuma | |

FOREIGN PATENT DOCUMENTS

| | | |
|---|---|---|
| CN | 102149841 | 8/2011 |
| EP | 2327810 | 6/2011 |
| EP | 2617849 B1 | 7/2013 |
| JP | 2004091924 | 3/2004 |

(Continued)

OTHER PUBLICATIONS

Korean Office Action for Korean Application No. 2015-7025312, dated Sep. 21, 2016, including Concise Statement of Relevance, 10 pages.

Chinese Office Action for Chinese Application No. 201480018925.7, dated Mar. 20, 2017, including Concise Statement of Search Report, 8 pages.

Supplementary European Search Report dated Mar. 21, 2016 for European Application No. 14774721.6.

International Search Report for International Application No. PCT/JP2014/001730 dated May 13, 2014.

Chinese Office Action for Chinese Application No. 201480018925.7, dated Jun. 30, 2016, including Concise Statement of Search Report, 14 pages.

*Primary Examiner* — Jessee R Roe

(74) *Attorney, Agent, or Firm* — RatnerPrestia

(57) ABSTRACT

There is provided a high-strength steel sheet having a tensile strength (TS) of 900 MPa or more and excellent elongation, stretch flangeability, and bendability in a component system in which an expensive alloy element is not intentionally added. A high-strength steel sheet includes a composition including, on a mass % basis, C: 0.15 to 0.40%, Si: 1.0 to 2.0%, Mn: 1.5 to 2.5%, P: 0.020% or less, S: 0.0040% or less, Al: 0.01 to 0.1%, N: 0.01% or less, and Ca: 0.0020% or less, with the balance including Fe and incidental impurities. The high-strength steel sheet has a microstructure including 40% to 70% of a ferrite phase and a bainite phase in total, 20% to 50% of a martensite phase, and 10% to 30% of a retained austenite phase in terms of an area fraction relative to the entire microstructure.

4 Claims, No Drawings

(56) References Cited

FOREIGN PATENT DOCUMENTS

| | | | |
|---|---|---|---|
| JP | 2008007854 | | 1/2008 |
| JP | 2010065272 | | 3/2010 |
| JP | 2010065273 | | 3/2010 |
| JP | 2010090475 | | 4/2010 |
| JP | 2011195956 | | 10/2011 |
| JP | 2012148305 | | 8/2012 |
| JP | 2012188738 | | 10/2012 |
| WO | 2012036269 | A1 | 3/2012 |
| WO | 2012048841 | | 4/2012 |

* cited by examiner

HIGH-STRENGTH STEEL SHEET AND METHOD FOR PRODUCING THE SAME

CROSS REFERENCE TO RELATED APPLICATIONS

This is the U.S. National Phase application of PCT International Application No. PCT/JP2014/001730, filed Mar. 26, 2014, and claims priority to Japanese Patent Application No. 2013-068295, filed Mar. 28, 2013, the disclosures of each of these applications being incorporated herein by reference in their entireties for all purposes.

FIELD OF THE INVENTION

The present invention relates to a high-strength steel sheet suitably used for automobile parts and the like and a method for producing the high-strength steel sheet, and to a high-strength steel sheet having a tensile strength (TS) of 900 MPa or more and preferably achieved without intentionally adding an expensive alloy element such as Ti, Nb, V, Cu, Ni, Cr, or Mo and methods for producing the high-strength steel sheet. Note that the high-strength steel sheet, in one embodiment of the present invention, includes a steel sheet having a surface coated with a zinc-based coating layer.

BACKGROUND OF THE INVENTION

Many members for automobiles have a complicated shape, and need to be made of a material having excellent elongation, stretch flangeability, and bendability, which are indices of formability. When the strength is increased to a TS of the 900 MPa class or more, a very expensive rare element such as Ti, Nb, V, Cu, Ni, Cr, or Mo is sometimes intentionally added to achieve high strength. Also, techniques disclosed in Patent Literature 1 and Patent Literature 2 are known as a technique in which high elongation is achieved while high strength is achieved by generating a retained austenite phase in a microstructure and using a TRIP effect due to strain induced transformation.

Patent Literature 1 proposes a technique concerning a steel sheet having excellent stretch flangeability. The steel sheet has a particular composition, and includes a primary-phase microstructure containing tempered martensite or tempered bainite, or also ferrite at a respective particular area fraction and a second-phase microstructure including retained austenite wherein the fraction of lath retained austenite in the retained austenite is 70% or more. Patent Literature 1 discloses a method for producing such a steel sheet. In the method, when tempered martensite or tempered bainite is a primary phase, a steel sheet subjected to a hot-rolling step and a cold-rolling step is rapidly cooled from an $A_3$ transformation temperature or more ($\gamma$ region) to an Ms temperature or less to obtain a martensite phase (quenched martensite phase) or is rapidly cooled from an $A_3$ transformation temperature or more ($\gamma$ region) to an Ms temperature or more and a Bs temperature or less to obtain a bainite phase (quenched bainite phase), heated and held at a temperature of an $A_1$ transformation temperature or more (about 700° C. or more) and an $A_3$ transformation temperature or less, and then cooled to a predetermined temperature and held for a predetermined time to temper the primary-phase microstructure while at the same time a desired second-phase microstructure is obtained. When a mixed microstructure of tempered martensite and ferrite ($\alpha$) or a mixed microstructure of tempered bainite and ferrite ($\alpha$) is a primary phase, a steel sheet subjected to a hot-rolling step and a cold-rolling step is rapidly cooled from an $A_1$ transformation temperature or more and an $A_3$ transformation temperature or less or an $A_3$ transformation temperature or more to an Ms temperature or less to obtain a mixed microstructure (quenched martensite phase+$\alpha$) of a martensite phase and ferrite or is rapidly cooled to an Ms temperature or more and a Bs temperature or less to obtain a bainite phase (quenched bainite phase+$\alpha$), heated and held at a temperature of an $A_1$ transformation temperature or more (about 700° C. or more) and an $A_3$ transformation temperature or less, and then cooled to a predetermined temperature and held for a predetermined time.

Patent Literature 2 discloses a technique concerning high-strength steel sheet having excellent stretch flangeability. The steel sheet has a particular composition including 2 to 20% of a retained austenite phase and, as a main phase, "a bainitic-ferrite (BF) phase having high dislocation density, which is distinct from a bainite phase". This technique proposes that the stretch flangeability of TRIP steel sheets including BF as a primary phase is improved by controlling the fraction of fine retained austenite to be 60% or more.

Patent Literature 3 discloses a technique concerning a high-strength thin steel sheet having excellent elongation and hole expandability (stretch flangeability). The steel sheet has a metal microstructure containing 3 to 30% of a retained austenite phase and mainly containing ferrite, bainite, or tempered martensite. This technique proposes that the concentration gradient of C in an austenite phase is controlled by controlling the cooling conditions after the concentration of C into the austenite phase is facilitated by bainite transformation or tempering of martensite, the stability of the retained austenite phase is increased, and thus the TRIP effect is effectively produced without degrading the hole expandability.

PATENT LITERATURE

PTL 1: Japanese Unexamined Patent Application Publication No. 2004-91924

PTL 2: Japanese Unexamined Patent Application Publication No. 2008-7854

PTL 3: Japanese Unexamined Patent Application Publication No. 2011-195956

SUMMARY OF THE INVENTION

A high-strength steel sheet having a TS of the 900 MPa class or more needs to also have good bendability, in addition to TS, elongation, and stretch flangeability. However, there are no findings on good bendability in the techniques according to Patent Literature 1 to Patent Literature 3.

In addition, in the case of the technique disclosed in Patent Literature 1, 0.45% or more of C needs to be added in order to achieve a TS of 900 MPa or more as disclosed in Table 2 and Table 3 of Patent Literature 1, which may result in insufficient joint strength regarding spot weldability. In the case of the technique disclosed in Patent Literature 2, the elongation is not sufficient, and thus it is difficult to achieve an excellent strength-elongation balance. The technique disclosed in Patent Literature 3 focuses on a retained austenite phase, and the object is to achieve high elongation by controlling the volume fraction and C concentration of the retained austenite phase. The retained austenite phase contributes to uniform elongation, but does not contribute to local elongation so much. Thus, a further improvement in elongation characteristics (total elongation: El) has been desired.

In view of the foregoing, it is an aim of aspects of the present invention to provide a high-strength steel sheet having a tensile strength (TS) of 900 MPa or more and excellent formability such as excellent elongation, stretch flangeability, and bendability in a component system in which an expensive alloy element such as Ti, Nb, V, Cu, Ni, Cr, or Mo is not intentionally added and to provide a method for producing the high-strength steel sheet.

To solve the above problems, the present inventors have conducted intensive studies. As a result, the inventors have found that a steel sheet having a tensile strength of 900 MPa or more and excellent elongation, stretch flangeability, and bendability may be produced by, e.g., satisfying a) and b) below even when the content of the above-described expensive scarce metal is low.

a) The C content is preferably 0.40% or less in terms of weldability and formability.

b) The metal microstructure includes a ferrite phase and a bainite phase, a martensite phase, and a retained austenite phase, and the area fractions of these phases are controlled within the predetermined ranges.

The present invention has been made on the basis of the above findings, and a non-limiting example thereof is as follows.

(1) An exemplary high-strength steel sheet includes a composition including, on a mass % basis:

C: 0.15 to 0.40%,
Si: 1.0 to 2.0%,
Mn: 1.5 to 2.5%,
P: 0.020% or less,
S: 0.0040% or less,
Al: 0.01 to 0.1%,
N: 0.01% or less, and
Ca: 0.0020% or less, with the balance comprising Fe and incidental impurities, wherein the high-strength steel sheet has a microstructure including 40% to 70% of a ferrite phase and a bainite phase in total, 20% to 50% of a martensite phase, and 10% to 30% of a retained austenite phase in terms of an area fraction relative to the entire microstructure.

(2) In the high-strength steel sheet according to (1), a surface of the high-strength steel sheet may be coated with a zinc-based coating layer.

(3) A method for producing an exemplary high-strength steel sheet includes, e.g., hot-rolling and pickling a steel slab having the composition in (1); then performing a first heat treatment in which the resulting sheet is heated to a temperature range of 400° C. to 750° C.; then cold-rolling the resulting sheet; then performing a second heat treatment in which the resulting sheet is heated to a temperature range of 800° C. to 950° C.; and then performing a third heat treatment in which the resulting sheet is heated to a temperature range of 700° C. to 850° C., subsequently cooled to a temperature range of 300° C. to 500° C. at a cooling rate of 10 to 80° C./s, and held in the temperature range for 100 to 1000 seconds.

(4) In the method for producing a high-strength steel sheet according to (3), a zinc-based coating treatment may be performed after the third heat treatment.

According to aspects of the present invention, there can be provided a high-strength steel sheet having a tensile strength of 900 MPa or more and excellent elongation, stretch flangeability, and bendability without intentionally adding the above-described expensive alloy element. The high-strength steel sheet produced in the present invention may be suitable for automobile parts that are press-formed into a complicated shape.

DETAILED DESCRIPTION OF EMBODIMENTS OF THE INVENTION

The present inventors have thoroughly studied an improvement in elongation, stretch flangeability, and bendability of high-strength steel sheets. As a result, the inventors have found that, even in a composition not containing Ti, Nb, V, Cu, Ni, Cr, or Mo, when the steel microstructure contains 40% to 70% of a ferrite phase and a bainite phase in total in terms of an area fraction relative to the entire microstructure, 20% to 50% of a martensite phase in terms of an area fraction relative to the entire microstructure, and 10% to 30% of a retained austenite phase in terms of an area fraction relative to the entire microstructure, the elongation, the stretch flangeability, and the bendability are considerably improved.

Hereafter, the preferred limited range and the reason for limitation of the chemical composition and the microstructure of steel for achieving a high-strength steel sheet having a tensile strength of 900 MPa or more and excellent elongation, stretch flangeability, and bendability will be described in detail. The unit of the content of each element in a steel sheet is mass %, and is simply indicated by % unless otherwise specified. First, the preferred limited range and the reason for limitation of the chemical composition of steel in accordance with aspects of the present invention are as follows.

C: 0.15% to 0.40%

C is an element for stabilizing austenite, and an element that affects the generation of a retained austenite phase and therefore contributes to an improvement in uniform elongation. C is also an element that affects the area fraction and hardness of a martensite phase and contributes to an increase in strength. If the C content is less than 0.15%, an excess amount of a ferrite phase is generated, which makes it difficult to achieve high tensile strength, and a desired amount of retained austenite is not generated, which makes it difficult to achieve excellent elongation. Therefore, the C content is 0.15% or more and preferably 0.18% or more. If the C content is more than 0.40%, the weldability considerably degrades and the martensite phase is excessively hardened, which makes it difficult to achieve excellent elongation and bendability. Therefore, the C content is desirably 0.40% or less, preferably 0.24% or less, and more preferably 0.22% or less. Accordingly, the C content is desirably in the range of 0.15% or more and 0.40% or less. The C content is preferably in the range of 0.18% or more and 0.24% or less in view of weldability. The C content is more preferably in the range of 0.18% or more and 0.22% or less.

Si: 1.0% to 2.0%

Si affects the generation of retained austenite and contributes to an improvement in uniform elongation. Si also contributes to an increase in strength due to solid solution hardening. If the Si content is less than 1.0%, it is difficult to generate a desired amount of retained austenite phase. Therefore, the Si content is 1.0% or more and preferably 1.2% or more. On the other hand, even when the Si content is more than 2.0%, the amount of retained austenite is not so affected. Further, if the Si content is more than 2.0%, the amount of Si concentrated on the surface increases, which generates defects of chemical conversion treatment and uncoated portions when plating. Therefore, the Si content is 2.0% or less, preferably 1.8% or less, and more preferably 1.6% or less. Accordingly, the Si content is in the range of 1.0% or more and 2.0% or less, preferably in the range of 1.2% or more and 1.8% or less, and more preferably in the range of 1.2% or more and 1.6% or less.

Mn: 1.5% to 2.5%

Mn is an element for stabilizing austenite, and an element that generates a desired amount of a martensite phase and contributes to an increase in strength. To produce the above effect, the Mn content is desirably 1.5% or more. The Mn content is preferably 1.8% or more and more preferably 2.0% or more. If the Mn content is more than 2.5%, the hardenability excessively increases and a desired amount of ferrite phase and bainite phase are not generated. Consequently, the area fraction of a martensite phase increases and hardening excessively proceeds, which makes it difficult to achieve excellent elongation and bendability. Therefore, the Mn content is desirably 2.5% or less and preferably 2.4% or less. Accordingly, the Mn content is in the desirable range of 1.5% or more and 2.5% or less, preferably in the range of 1.8% or more and 2.4% or less, and more preferably in the range of 2.0% or more and 2.4% or less.

P: 0.020% or Less

P adversely affects the weldability, and thus the P content is preferably as low as possible. In particular, when the P content is more than 0.020%, the weldability considerably degrades, but the P content of up to 0.020% is acceptable. Therefore, the P content is 0.020% or less and preferably less than 0.010%. If the P content is excessively decreased, the production efficiency in the steelmaking process decreases, resulting in an increase in cost. Accordingly, the lower limit of the P content is preferably about 0.001%. The P content is preferably in the range of 0.001% or more and 0.020% or less, and more preferably in the range of 0.001% or more and less than 0.010% in view of weldability.

S: 0.0040% or Less

S is present in the steel as an inclusion and serves as a point of causing inclusion cracking, and thus the S content is preferably as low as possible. In particular, when the S content is more than 0.0040%, the stretch flangeability considerably degrades, but the S content of up to 0.0040% is acceptable. Therefore, the S content is 0.0040% or less and preferably 0.0020% or less. It is industrially difficult to excessively decrease the S content. Such an excessive decrease in the S content increases the desulfurization cost in the steelmaking process and decreases the productivity. Accordingly, the lower limit of the S content is preferably about 0.0001%. The S content is preferably in the range of 0.0001% or more and 0.0040% or less and more preferably in the range of 0.0001% or more and 0.0020% or less.

Al: 0.01% to 0.1%

Al is added as a deoxidizer for steel, and the Al content desirably is 0.01% or more and is preferably 0.02% or more. The addition of more than 0.1% of Al increases the number of inclusions in a surface layer portion of the steel sheet, such as alumina, and the bendability degrades. Therefore, the Al content desirably is 0.1% or less, preferably 0.08% or less, and more preferably 0.06% or less. Accordingly, the Al content desirably is in the range of 0.01% or more and 0.1% or less, preferably in the range of 0.02% or more and 0.08% or less, and more preferably in the range of 0.02% or more and 0.06% or less.

N: 0.01% or Less

N is an element that affects the aging, and the N content is preferably as low as possible. In particular, when the N content is more than 0.01%, the strain aging considerably appears. Therefore, the N content may desirably be 0.01% or less and is preferably 0.0060% or less. If the N content is excessively decreased, the denitrification cost increases in the steelmaking process and the productivity decreases. Therefore, the lower limit of the N content is preferably about 0.0001%. Accordingly, the N content is preferably in the range of 0.0001% or more and 0.01% or less and more preferably in the range of 0.0001% or more and 0.0060% or less.

Ca: 0.0020% or Less

If Ca inclusions are present in a surface layer of the steel sheet, the inclusions serve as points of causing point-like ultrafine cracking during bending, which makes it difficult to achieve excellent bendability. Therefore, the Ca content is desirably as low as possible, but the Ca content of up to 0.0020% is acceptable. The Ca content is 0.0020% or less and preferably less than 0.0005%. It is industrially difficult to excessively decrease the Ca content. Such an excessive decrease in the Ca content increases the cost. Therefore, the lower limit of the Ca content is preferably about 0.0001%. The Ca content is preferably in the range of 0.0001% or more and 0.0020% or less and more preferably in the range of 0.0001% or more and less than 0.0005%.

In the steel sheet, in accordance with one embodiment of the present invention, components other than the above-described components are Fe and incidental impurities. Components other than the above-described components may be used as long as the effects of the present invention are not impaired.

To achieve an aim of one aspect of the present invention in which an expensive alloy element is not intentionally added, Ti, Nb, V, Cu, Ni, Cr, or Mo is preferably not contained.

Next, the limited desirable range and the reason for limitation of a steel microstructure, which is advantageous for one aspect of the present invention, will be described in detail.

Total Area Fraction of Ferrite Phase and Bainite Phase Relative to the Entire Microstructure: 40% to 70%

A bainite phase constituted by cementite and a ferrite phase and a ferrite phase are softer than a martensite phase. In order to achieve desired elongation and bendability through contribution to elongation and bendability, the total area fraction of a bainite phase and a ferrite phase is desirably 40% or more relative to the entire microstructure. If the total area fraction of the ferrite phase and the bainite phase is less than 40%, the area fraction of a hard martensite phase increases. This excessively increases the strength, which degrades the elongation and also the bendability. Consequently, desired elongation and bendability may not be achieved. The total area fraction of the ferrite phase and the bainite phase is preferably 45% or more. If the total area fraction of the ferrite phase and the bainite phase is more than 70%, it is difficult to achieve a strength of 900 MPa or more. It is also difficult to achieve a desired amount of retained austenite phase that contributes to elongation. Therefore, the total area fraction of the ferrite phase and the bainite phase is 70% or less and preferably 65% or less. Accordingly, the total area fraction of the ferrite phase and the bainite phase desirably is in the range of 40% or more and 70% or less and preferably in the range of 45% or more and 65% or less.

Area Fraction of Martensite Phase Relative to the Entire Microstructure: 20% to 50%

A hard martensite phase having high dislocation density is clearly differentiated from a tempered soft martensite phase having low dislocation density. The hard martensite phase considerably contributes to strength, and the area fraction of the martensite phase is desirably 20% or more to achieve a TS of 900 MPa or more. If the area fraction of the martensite phase is excessively large, the strength excessively increases and the elongation decreases. Therefore, the area fraction of the martensite phase is desirably 50% or less and is preferably 40% or less. As described above, when the area fraction of the martensite phase is 20% or more and 50% or less relative to the entire microstructure, good elongation is achieved. The area fraction of the martensite phase is preferably in the range of 20% or more and 40% or less.

Area Fraction of Retained Austenite Phase Relative to the Entire Microstructure: 10% to 30%

A retained austenite phase produces an effect of improving uniform elongation due to strain induced transformation. That is, a portion distorted when a material is deformed is transformed into a martensite phase and the deformed portion is hardened to prevent the concentration of strain, thereby improving uniform elongation. To achieve high uniform elongation, the retained austenite phase is desirably contained at an area fraction of 10% or more. However, the retained austenite phase has a high C concentration and thus is hard. If the retained austenite phase is excessively present in the steel sheet at an area fraction of more than 30%, locally hard portions are present and local elongation is degraded, which makes it difficult to achieve excellent elongation (total elongation) and bendability. Therefore, the area fraction of the retained austenite phase is 30% or less and preferably 20% or less. Accordingly, the area fraction of the retained austenite phase is in the range of 10% or more and 30% or less and preferably in the range of 10% or more and 20% or less.

Regarding the remaining microstructures other than the microstructures specified above, about 5% or less of unavoidably generated microstructures such as cementite in terms of total area fraction may be contained because the effects of the present invention are not impaired.

A surface of the high-strength steel sheet in accordance with one embodiment of the present invention may be coated with a zinc-based coating layer to obtain a high-strength steel sheet including a zinc coating-based layer on its surface (galvanized steel sheet). The influence of the coating on the properties of the high-strength steel sheet, in accordance with one embodiment of the present invention, is small, and the tensile strength, elongation, and the like equal to those of the high-strength steel sheet before the zinc-based coating layer is formed can be achieved. Herein, the zinc-based coating is a coating containing 70 mass % or more of zinc and is preferably a Zn coating, a Zn—Ni coating, or the like, which may be used for automobile steel sheets. The coating weight is preferably about 3 to 80 g/m$^2$ per side.

Next, a method for producing a high-strength steel sheet according to one aspect of the present invention will be described.

An intended high-strength steel sheet in accordance with one embodiment of the present invention is produced by hot-rolling and pickling a steel slab having the above-described composition; then performing a first heat treatment in which the resulting sheet is heated to a temperature range of 400° C. to 750° C.; then cold-rolling the resulting sheet; then performing a second heat treatment in which the resulting sheet is heated to a temperature range of 800° C. to 950° C.; and then performing a third heat treatment in which the resulting sheet is heated to a temperature range of 700° C. to 850° C., subsequently cooled to a temperature range of 300° C. to 500° C. at a cooling rate of 10 to 80° C./s, and held in the temperature range for 100 to 1000 seconds. Temper rolling may also be performed on the steel sheet after the third heat treatment.

Hereafter, the limited desirable range and the reason for desired limitations of production conditions will be described in detail.

In the present invention, the production of a steel slab is not particularly limited and may be conducted by a typical method such as thin slab casting, ingot making, or continuous slab casting. For example, a steel slab can be produced by preparing a molten steel having a composition within the above-described range in a vacuum melting furnace, a steel converter, or the like and then performing casting. In the present invention, the steel slab may be, for example, a continuously cast slab or a slab obtained by ingot making and blooming. In a particular embodiment, a slab produced by continuous casting is preferably used to reduce segregation.

The hot-rolling is also not particularly limited and may be performed by a typical method. The heating temperature of steel slab before hot-rolling is preferably 1100° C. or more. The upper limit of the heating temperature is preferably about 1300° C. for the purpose of reducing the formation of scale and reducing the fuel consumption rate. The finishing temperature (finishing delivery temperature) of the hot-rolling is preferably 850° C. or more for the purpose of avoiding the generation of layered microstructures composed of such as ferrite and pearlite. The upper limit of the finishing temperature of the hot-rolling is preferably about 950° C. for the purpose of reducing the formation of scale and generating a fine and uniform microstructure by suppressing an increase in crystal grain size. The coiling temperature after the completion of the hot-rolling is preferably 400° C. or more and is also preferably 600° C. or less, in view of cold rollability and surface quality. Therefore, the coiling temperature is preferably 400° C. to 600° C.

The hot-rolled steel sheet after the coiling may be pickled by a typical method. The pickling conditions are not particularly limited. A publicly known method such as pickling with hydrochloric acid may be employed.

The hot-rolled steel sheet after the pickling may be sequentially subjected to a first heat treatment (heat treatment at the first time), a cold-rolling step, a second heat treatment (heat treatment at the second time), and a third heat treatment (heat treatment at the third time). The cold-rolling is not particularly limited and may be performed by a publicly known method. The reduction ratio of the cold-rolling is not particularly limited, but is preferably 30% or more and 60% or less. Therefore, the reduction ratio of the cold-rolling is preferably about 30% to 60%.

Heat Treatment Temperature in First Heat Treatment: 400° C. to 750° C.

In the first heat treatment performed after the hot-rolling, the hot-rolled microstructure is eliminated to form a uniform microstructure constituted by a ferrite phase and cementite. The first heat treatment is useful for eliminating the uneven distribution of elements such as C and Mn due to the hot-rolled microstructure and obtaining a desired microstructure after the second and third heat treatments. If the heat treatment temperature in the first heat treatment is less than 400° C., tempering after the hot-rolling may be insufficient and the influence of the microstructure after the hot-rolling may not be removed. Therefore, if the heat treatment temperature is less than 400° C., the hardenability increases in a region, in which a large amount of C is originally present, even after the second heat treatment and the third heat treatment due to the uneven distribution of C and Mn. Consequently, a desired area fractions of ferrite phase and bainite phase may not be generated, and thus sufficient elongation and bendability may not be achieved. Furthermore, if the heat treatment temperature is less than 400° C., softening of the hot-rolled steel sheet may not be sufficiently promoted and thus the hard hot-rolled steel sheet is cold-rolled. Consequently, the load of the cold-rolling increases, which increases the cost. Therefore, the heat treatment temperature in the first heat treatment is 400° C. or more. The heat treatment temperature in the first heat treatment is preferably 450° C. or more. The heat treatment temperature in the first heat treatment is more preferably 500° C. or more. If the heat treatment is performed at more than 750° C., a coarse and hard martensite phase is excessively present after the heat treatment in addition to the ferrite phase. Consequently, the microstructure after the third heat treatment becomes nonuniform, and the area fraction of the martensite phase increases. Therefore, the strength of the steel sheet after the third heat treatment is excessively increased, which considerably degrades the elongation and the bendability. Accordingly, the heat treatment temperature in the first heat treatment is desirably 750° C. or less, preferably 700° C. or less, and more preferably 650° C. or less. As described above, in the first heat treatment for the hot-rolled steel sheet, an optimum temperature range is provided in order to obtain an extremely uniform microstructure before the cold-rolling. In the first heat treatment, heating is performed to a desirable temperature range of 400° C. to 750° C. That is, the heat treatment temperature in the first heat treatment is in the desirable range of 400° C. or more and 750° C. or less, preferably in the range of 450° C. or more and 700° C. or less, and more preferably in the range of 450° C. or more and 650° C. or less.

Heat Treatment Temperature in Second Heat Treatment: 800° C. to 950° C.

The cold-rolled steel sheet after the cold-rolling may be subjected to a second heat treatment (annealing). If the heat treatment temperature is less than 800° C., the austenite fraction during the heat treatment is small and C is distributed into the austenite. Furthermore, since the heat treatment temperature is low, the austenite grain size during the heat treatment is not coarsened. That is, austenite having high C concentration is finely dispersed during the heat treatment. Therefore, when the heat treatment temperature in the second heat treatment is less than 800° C., the steel sheet after the second heat treatment includes interspersed regions having high C concentration. If such a steel sheet is subjected to the third heat treatment, regions originally having high C concentration are preferentially transformed into a martensite phase after the third heat treatment, which increases the area fraction of the martensite phase and degrades the elongation and the bendability. Therefore, the heat treatment temperature in the second heat treatment is desirably 800° C. or more and preferably 840° C. or more. If the heat treatment temperature in the second heat treatment, that is, the annealing temperature exceeds 950° C. and the heating is performed to the temperature range of an austenite single phase, the austenite grain size may be excessively increased. Consequently, the grain size of crystal grains obtained in the end is also excessively coarsened, and the number of grain boundaries, which are nucleation sites for the ferrite phase, is decreased. If such a steel sheet is subjected to the third heat treatment, the generation of the ferrite phase may be suppressed in the third heat treatment, which increases the area fraction of the martensite phase and degrades the elongation and the bendability. Therefore, the heat treatment temperature in the second heat treatment is desirably 950° C. or less and preferably 940° C. or less. Accordingly, the heating is performed to 800° C. to 950° C. in the second heat treatment. In other words, the heat treatment temperature (annealing temperature) in the second heat treatment is desirably 800° C. or more and 950° C. or less and preferably 840° C. or more and 940° C. or less.

Although not particularly specified, the cooling rate after the annealing is preferably 10° C./s or more and 80° C./s or less in order to achieve a good balance between the ferrite phase, the bainite phase, the martensite phase, and the retained austenite phase after the third heat treatment performed next. Therefore, the cooling rate after the annealing is preferably 10 to 80° C./s. The cooling means is preferably gas cooling, but is not particularly specified. Existing cooling means such as air cooling, mist cooling, roll cooling, or water cooling can also be employed including combination of aforementioned cooling means. Although not particularly limited, the second heat treatment is preferably performed in a continuous annealing furnace in view of productivity. Although not particularly specified, the cooling stop temperature in the cooling after the annealing is preferably 300° C. or more and 500° C. or less in order to facilitate the bainite transformation, generate a desired amount of retained austenite phase, and achieve a good balance between the elongation and the bendability. Therefore, the cooling stop temperature in the cooling after the annealing is preferably in the range of 300° C. to 500° C. The steel sheet is preferably held in the cooling stop temperature range for 100 seconds or more and 1000 seconds or less to cause the concentration of C into the austenite phase and obtain a desired amount of retained austenite. Therefore, the steel sheet is preferably held in the cooling stop temperature range for 100 to 1000 seconds.

The steel sheet after the second heat treatment (after the annealing) may be subjected to a third heat treatment in which the steel sheet is heated, e.g., to a temperature range of 700° C. to 850° C., then cooled to a temperature range of 300° C. to 500° C. at a cooling rate of 10 to 80° C./s, and held in the temperature range for 100 to 1000 seconds.

Heat Treatment Temperature in Third Heat Treatment: 700° C. to 850° C.

If the heat treatment temperature in the third heat treatment is less than 700° C., the area fraction of the ferrite phase during the heat treatment is excessively increased, which makes it difficult to achieve a TS of 900 MPa or more. Therefore, the heat treatment temperature in the third heat treatment is desirably 700° C. or more and preferably 740° C. or more. If the heat treatment temperature is more than 850° C., the area fraction of the austenite phase during the heat treatment is increased. This decreases the area fraction of the ferrite phase and increases the area fraction of the martensite phase of the steel sheet after the cooling and the holding. Therefore, when the heat treatment temperature exceeds 850° C., the area fraction of the martensite phase may exceed 50% in the end, which makes it difficult to achieve the elongation and the bendability. Therefore, the heat treatment temperature in the third heat treatment is desirably 850° C. or less and preferably 820° C. or less. Accordingly, the heating is performed to 700° C. to 850° C. in the third heat treatment. That is, the heat treatment temperature in the third heat treatment is in the range of 700° C. or more and 850° C. or less and preferably in the range of 740° C. or more and 820° C. or less.

Cooling Rate: 10 to 80° C./s

In the third heat treatment, the cooling rate after the heating to the heat treatment temperature may be important for achieving desired area fractions of phases. If the cooling rate is less than 10° C./s, the ferrite phase may be excessively generated and the softening may be excessively promoted, which makes it difficult to achieve a TS of 900 MPa or more. Therefore, the cooling rate is desirably 10° C./s or more and preferably 15° C./s or more. If the cooling rate is more than 80° C./s, the martensite phase may be excessively generated and the hardness may be excessively increased, which degrades the elongation. Therefore, the cooling rate is desirably 80° C./s or less, preferably 60° C./s or less, and more preferably 40° C./s or less. Accordingly, the cooling rate is in the desired range of 10 to 80° C./s, preferably in the range of 10° C./s or more and 60° C./s or less, and more preferably in the range of 10° C./s or more and 40° C./s or less. Herein, the cooling rate is an average cooling rate from the heat treatment temperature to the cooling stop temperature. The cooling means is preferably gas cooling, but is not particularly limited. Furnace cooling, mist cooling, roll cooling, water cooling, and the like can also be employed including combination of aforementioned cooling means.

Cooling Stop Temperature: 300° C. to 500° C.

If the cooling stop temperature is less than 300° C., the generation of the retained austenite phase may be suppressed and the martensite phase is excessively generated. Consequently, the strength of a steel sheet to be obtained in the end is excessively increased, which makes it difficult to achieve the elongation and the bendability. Therefore, the cooling stop temperature is desirably 300° C. or more and preferably 320° C. or more. If the cooling stop temperature is more than 500° C., the bainite transformation is delayed and the generation of the retained austenite phase is suppressed, which makes it difficult to achieve excellent elongation and bendability in a steel sheet to be obtained in the end. Therefore, the cooling stop temperature is desirably 500° C. or less and preferably 450° C. or less. The cooling is performed to a temperature range of 300° C. to 500° C. at the above-described cooling rate in order to achieve excellent elongation, stretch flangeability, and bendability while achieving a TS of 900 MPa or more by providing a microstructure mainly including the ferrite phase and the bainite phase and by controlling the existence ratio of the martensite phase and the retained austenite phase. That is, the cooling stop temperature is in the desired range of 300° C. or more and 500° C. or less and preferably in the range of 300° C. or more and 450° C. or less.

Holding Time at 300° C. to 500° C.: 100 Seconds or More and 1000 Seconds or Less After the stop of the cooling, a so-called overaging treatment in which the steel sheet may be held in a temperature range of 300° C. to 500° C. for 100 to 1000 seconds in order to cause the concentration of C into the austenite phase and obtain a desired amount of retained austenite. If the holding time is less than 100 seconds, the time required to cause the concentration of C into the austenite phase may be insufficient, which makes it difficult to achieve a desired area fraction of the retained austenite in the end and also excessively provides the martensite phase. Thus, if the holding time is less than 100 seconds, the strength of the steel sheet may excessively increase and the elongation and the bendability may degrade. Therefore, the holding time is desirably 100 seconds or more and preferably 150 seconds or more. On the other hand, even if the steel sheet is retained for more than 1000 seconds, the amount of retained austenite may not increase and a marked increase in elongation may not be recognized. Therefore, the holding time is desirably 1000 seconds or less and preferably 800 seconds or less. Accordingly, the holding time (overaging treatment time) is in the desired range of 100 seconds or more and 1000 seconds or less and preferably in the range of 150 seconds or more and 800 seconds or less. After the holding time, although not particularly limited, cooling may be performed to ordinary temperature by a typical method such as air cooling or gas cooling. Although not particularly limited, the third heat treatment is preferably performed in a continuous annealing furnace in view of productivity.

The high-strength steel sheet after the third heat treatment may be further subjected to a zinc-based coating treatment in which a surface of the steel sheet is coated with a zinc-based coating layer. A typical coating method may be employed. For example, when a zinc-based coated steel sheet is produced, zinc-based plating can be performed continuously after the annealing in a continuous electrogalvanizing line.

Example 1

A molten steel having a composition shown in Table 1 was prepared to produce a slab. The slab was hot-rolled at a heating temperature of 1200° C., at a finishing delivery temperature of 880° C., and at a coiling temperature of 480° C., pickled with hydrochloric acid, and then subjected to a heat treatment at the first time (first heat treatment) under the conditions shown in Table 2. Subsequently, the hot rolled steel sheet was subjected to cold-rolling at a reduction ratio of 40% to 50%, a heat treatment at the second time (second heat treatment), and a heat treatment at the third time (third heat treatment) under the conditions shown in Table 2 to produce a cold-rolled steel sheet having a thickness of 1.0 mm. After the heat treatment at the third time, both surfaces of some of the produced steel sheets were coated with a Zn—Ni alloy coating layer containing 12 mass % of Ni, which was a zinc-based coating layer, at a coating weight of 20 g/m$^2$ per side to produce an electrogalvanized steel sheet. The cold-rolled steel sheets and electrogalvanized steel sheets were examined in terms of material properties (microstructure of steel sheet, tensile properties, stretch flangeability, and bendability) as described below. Table 3 shows the results.

TABLE 1

| Steel | Chemical composition (mass %) | | | | | | | | |
|---|---|---|---|---|---|---|---|---|---|
| type | C | Si | Mn | P | S | Al | N | Ca | Remarks |
| A | 0.200 | 1.40 | 2.20 | 0.009 | 0.0009 | 0.045 | 0.0038 | 0.0003 | Invention Example |
| B | 0.220 | 1.55 | 2.00 | 0.008 | 0.0007 | 0.040 | 0.0045 | 0.0004 | Invention Example |
| C | 0.180 | 1.50 | 2.40 | 0.006 | 0.0006 | 0.055 | 0.0052 | 0.0003 | Invention Example |
| D | 0.340 | 1.25 | 1.55 | 0.005 | 0.0005 | 0.036 | 0.0042 | 0.0004 | Invention Example |
| E | 0.210 | 1.50 | 2.10 | 0.007 | 0.0008 | 0.038 | 0.0031 | 0.0002 | Invention Example |
| F | 0.450 | 1.40 | 2.00 | 0.008 | 0.0009 | 0.044 | 0.0045 | 0.0004 | Comparative Example |

TABLE 2

| No. | Steel type | First heat treatment | Second heat treatment | | | | Third heat treatment | | | | Coating treatment | Remarks |
|---|---|---|---|---|---|---|---|---|---|---|---|---|
| | | Heat treatment temperature (° C.) | Heat treatment temperature (° C.) | Cooling rate (° C./s) | Cooling stop temperature (° C.) | Holding time (s) | Heat treatment temperature (° C.) | Cooling rate (° C./s) | Cooling stop temperature (° C.) | Holding time (s) | With (Yes) or without (No) coating treatment | |
| 1 | A | 500 | 920 | 20 | 400 | 150 | 810 | 15 | 375 | 180 | Yes | Invention Example |
| 2 | B | 650 | 900 | 40 | 360 | 360 | 760 | 20 | 325 | 360 | No | Invention Example |
| 3 | C | 540 | 880 | 60 | 440 | 450 | 780 | 25 | 450 | 600 | Yes | Invention Example |
| 4 | D | 560 | 860 | 50 | 380 | 600 | 800 | 30 | 350 | 420 | No | Invention Example |
| 5 | E | 550 | 860 | 20 | 400 | 180 | 820 | 20 | 400 | 240 | No | Invention Example |
| 6 | F | 540 | 840 | 20 | 420 | 240 | 830 | 40 | 425 | 300 | Yes | Comparative Example |
| 7 | A | 300 | 850 | 30 | 440 | 860 | 770 | 60 | 450 | 480 | No | Comparative Example |
| 8 | A | 780 | 870 | 40 | 460 | 300 | 760 | 70 | 460 | 700 | No | Comparative Example |
| 9 | A | 480 | 720 | 50 | 480 | 720 | 730 | 55 | 420 | 900 | Yes | Comparative Example |
| 10 | A | 520 | 980 | 15 | 450 | 420 | 750 | 35 | 400 | 800 | Yes | Comparative Example |
| 11 | A | 460 | 860 | 25 | 425 | 580 | 650 | 25 | 380 | 420 | Yes | Comparative Example |
| 12 | A | 540 | 850 | 35 | 400 | 540 | 900 | 15 | 360 | 180 | Yes | Comparative Example |
| 13 | A | 500 | 880 | 55 | 375 | 160 | 830 | 2 | 340 | 300 | No | Comparative Example |
| 14 | A | 560 | 890 | 75 | 350 | 410 | 810 | 150 | 375 | 150 | No | Comparative Example |
| 15 | A | 580 | 900 | 70 | 325 | 550 | 790 | 20 | 200 | 450 | Yes | Comparative Example |
| 16 | A | 440 | 880 | 50 | 380 | 340 | 770 | 40 | 550 | 200 | Yes | Comparative Example |
| 17 | A | 500 | 910 | 30 | 400 | 220 | 780 | 60 | 400 | 30 | Yes | Comparative Example |
| 18 | A | 550 | 930 | 20 | 420 | 130 | 820 | 30 | 425 | 1500 | Yes | Comparative Example |

Microstructure of Steel Sheet

The area fraction of each phase in the entire microstructure was determined by observing a cross-section in the rolling direction, the observed cross-section being located at a depth of one quarter of the sheet thickness, using an optical microscope. Using a cross-sectional microstructure photograph with a magnification ratio of 1000 times, the occupation area in a freely selected square region having a size of 100 μm×100 μm was determined by image analysis. The observation was performed with N=5 (5 observation fields). In the microstructure observation, etching was performed with a mixed solution of 3 vol. % of picral and 3 vol. % sodium metabisulfite. A black region observed in the microstructure observation was recognized as a ferrite phase (polygonal ferrite phase) or a bainite phase, and the total area fraction of the ferrite phase and the bainite phase was determined. A remaining region other than the black region was recognized as a martensite phase and a retained austenite phase, and the total area fraction of the martensite phase and the retained austenite phase was determined. Furthermore, the amount of retained austenite was separately measured by X-ray diffraction. The area fraction of the martensite phase was determined by subtracting the area fraction of the retained austenite phase from the total area fraction of the martensite phase and the retained austenite phase. The area fraction of the retained austenite was determined by X-ray diffraction using Kα rays of Mo. Specifically, a test piece was prepared so as to have a measurement surface which was a surface located at a depth of about one quarter of the sheet thickness of the steel sheet. The volume fraction of the retained austenite phase was calculated from the peak intensities of (211) and (220) planes of the austenite phase and the peak intensities of (200) and (220) planes of the ferrite phase, and the volume fraction was defined as an area fraction.

Tensile Properties (Tensile Strength and Elongation)

A tensile test was performed in conformity with JIS Z2241 using a No. 5 test piece which is described in JIS Z2201 and whose longitudinal direction (cross-head moving direction) is a direction perpendicular to the rolling direction. The yield point (YP), the tensile strength (TS), and the total elongation (El) were measured. Table 3 shows the results. The elongation was evaluated by a TS-El balance. When TS×El27000 MPa·%, the elongation was evaluated to be good. When TS×El≥28000 MPa·%, the elongation was evaluated to be excellent.

Stretch Flangeability

The hole expansion ratio was measured in conformity with The Japan Iron and Steel Federation Standard JFS T1001. Specifically, punching was performed on the steel sheet to form a hole having an initial diameter of $d_0$=10 mm. When a 60° conical punch was lifted up to expand the hole and the crack penetrated the sheet in a thickness direction, the lifting of the punch was stopped. The punched hole diameter d after the penetration of the crack was measured, and the hole expansion ratio (%)=$((d-d_0)/d_0)\times100$ was calculated. This test was conducted three times for the steel sheet with the same No. to determine the average (λ) of the hole expansion ratio. The stretch flangeability was evaluated by a TS-λ balance. When TS×λ≥30000 MPa·%, the stretch flangeability was evaluated to be good.

Bendability

A bend test piece was prepared using the produced steel sheet having a thickness of t=1.0 mm so that the direction of the ridgeline of a bent portion was parallel with the rolling direction. The bend test piece had a size of 40 mm×100 mm, and the direction perpendicular to the rolling direction was the longitudinal direction of the bend test piece. Using the prepared bend test piece, 90° V bending was performed at a pressing load of 29.4 kN at a bottom dead center with a die having an edge bending radius of R=2.0 mm. The presence or absence of cracks at the bending top was visually judged. When no cracks were formed, the bendability was evaluated to be good.

TABLE 3

| | | Microstructure | | | Material properties | | | | | | | |
|---|---|---|---|---|---|---|---|---|---|---|---|---|
| No. | Steel type | Total area fraction of ferrite phase and bainite phase (%) | Area fraction of martensite phase (%) | Area fraction of retained austenite phase (%) | YP (MPa) | TS (MPa) | El (%) | λ (%) | TS × El (MPa · %) | TS × λ (MPa · %) | With (Yes) or without (No) crack at bending edge | Remarks |
| 1 | A | 63 | 22 | 15 | 625 | 920 | 31 | 35 | 28520 | 32200 | No | Invention Example |
| 2 | B | 55 | 28 | 17 | 610 | 1010 | 28 | 31 | 28280 | 31310 | No | Invention Example |
| 3 | C | 54 | 30 | 16 | 615 | 990 | 29 | 32 | 28710 | 31680 | No | Invention Example |
| 4 | D | 48 | 34 | 18 | 875 | 1220 | 23 | 33 | 28060 | 40260 | No | Invention Example |
| 5 | E | 56 | 29 | 15 | 630 | 930 | 32 | 35 | 29760 | 32550 | No | Invention Example |
| 6 | F | 52 | 36 | 12 | 960 | 1270 | 16 | 10 | 20320 | 12700 | Yes | Comparative Example |
| 7 | A | 36 | 46 | 18 | 910 | 1140 | 15 | 25 | 17100 | 28500 | Yes | Comparative Example |
| 8 | A | 31 | 53 | 16 | 990 | 1170 | 16 | 22 | 18720 | 25740 | Yes | Comparative Example |
| 9 | A | 38 | 51 | 11 | 670 | 1090 | 13 | 18 | 14170 | 19620 | Yes | Comparative Example |
| 10 | A | 34 | 54 | 12 | 690 | 1070 | 14 | 17 | 14980 | 18190 | Yes | Comparative Example |
| 11 | A | 75 | 17 | 8 | 570 | 830 | 24 | 40 | 19920 | 33200 | No | Comparative Example |
| 12 | A | 35 | 58 | 7 | 950 | 1190 | 15 | 31 | 17850 | 36890 | Yes | Comparative Example |
| 13 | A | 72 | 23 | 5 | 650 | 870 | 22 | 35 | 19140 | 30450 | No | Comparative Example |
| 14 | A | 38 | 46 | 16 | 630 | 1100 | 18 | 33 | 19800 | 36300 | Yes | Comparative Example |
| 15 | A | 35 | 60 | 5 | 960 | 1420 | 12 | 25 | 17040 | 35500 | Yes | Comparative Example |
| 16 | A | 51 | 45 | 4 | 1000 | 1080 | 19 | 34 | 20520 | 36720 | Yes | Comparative Example |
| 17 | A | 55 | 42 | 3 | 940 | 1120 | 17 | 36 | 19040 | 40320 | Yes | Comparative Example |
| 18 | A | 65 | 17 | 18 | 630 | 760 | 31 | 43 | 23560 | 32680 | No | Comparative Example |

It is found from Table 3 that, in the non-limiting Invention Examples, a high-strength steel sheet is obtained which had a tensile strength of 900 MPa or more, has excellent elongation, stretch flangeability, and bendability, causes no cracking in the 90° V bending at a bend radius ratio of (R/t)=2, and satisfies TS×El27000 MPa·% and TS×λ≥30000 MPa·%.

On the other hand, the steel sheet No. 6 in which the C content exceeds the desired range of the present invention has low elongation. The steel sheet No. 7 in which the heat treatment temperature in the first heat treatment is below the desired range of the present invention, the steel sheet No. 8 in which the heat treatment temperature in the first heat treatment is above the desired range of the present invention, the steel sheet No. 12 in which the heat treatment temperature in the third heat treatment is above the desired range of the present invention, and the steel sheet No. 14 in which the cooling rate after the heat treatment in the third heat treatment is above the desired range of the present invention have a low total area fraction of the ferrite phase and the bainite phase relative to the entire microstructure, low elongation, and poor bendability. The steel sheet No. 9 in which the heat treatment temperature in the second heat treatment is below the desired range of the present invention and the steel sheet No. 10 in which the heat treatment temperature in the second heat treatment is above the desired range of the present invention have a low total area fraction of the ferrite phase and the bainite phase relative to the entire microstructure, a high area fraction of the martensite phase, low elongation, and poor bendability. The steel sheet No. 11 in which the heat treatment temperature in the third heat treatment is below the desired range of the present invention and the steel sheet No. 13 in which the cooling rate after the heat treatment in the third heat treatment is below the desired range of the present invention have a high total area fraction of the ferrite phase and the bainite relative to the entire microstructure and a TS of less than 900 MPa. The steel sheet No. 15 in which the cooling stop temperature in the third heat treatment is below the desired range of the present invention, the steel sheet No. 16 in which the cooling stop temperature in the third heat treatment is above the desired range of the present invention, and the steel sheet No. 17 in which the holding time (overaging time) in the third heat treatment is below the desired range of the present invention have a low area fraction of the retained austenite phase and low elongation. The steel sheet No. 18 in which the holding time (overaging time) in the third heat treatment is above the desired range of the present invention has a low area fraction of the martensite phase and a TS of less than 900 MPa.

According to aspects of the present invention, there can be provided a high-strength steel sheet having a tensile strength (TS) of 900 MPa or more and excellent elongation, stretch flangeability, and bendability at low cost without intentionally adding an expensive alloy element such as Nb, V, Cu, Ni, Cr, or No to the steel sheet. The high-strength steel sheet, in accordance with aspects of the present invention, is suitably applicable to the fields of, for example, construction and household appliances where strict dimensional accuracy and workability are required, in addition to automobile parts.

The invention claimed is:

1. A high-strength steel sheet comprising a composition including, on a mass % basis:

C: 0.15 to 0.40%,

Si: 1.0 to 2.0%,

Mn: 1.5 to 2.5%,

P: 0.020% or less,

S: 0.0040% or less,

Al: 0.01 to 0.1%,

N: 0.01% or less, and

Ca: 0.0020% or less, with the balance comprising Fe and incidental impurities, wherein the high-strength steel sheet has a microstructure including 40% to 70% of a ferrite phase and a bainite phase in total, 20% to 50% of a martensite phase, and 10% to 30% of a retained austenite phase in terms of an area fraction relative to the entire microstructure, with a total area fraction of remaining microstructures being 5% or less relative to the entire microstructure, and wherein the high-strength steel sheet has a tensile strength (TS) and total elongation (El) such that TS×El≥27000 MPa·%.

2. The high-strength steel sheet according to claim 1, wherein a surface of the high-strength steel sheet is coated with a zinc-based coating layer.

3. A method for producing a high-strength steel sheet, comprising hot-rolling and pickling a steel slab having the composition in claim 1; then performing a first heat treatment in which the resulting sheet is heated to a temperature range of 400° C. to 750° C.; then cold-rolling the resulting sheet; then performing a second heat treatment in which the resulting sheet is heated to a temperature range of 800° C. to 950° C.; and then performing a third heat treatment in which the resulting sheet is heated to a temperature range of 700° C. to 850° C., subsequently cooled to a temperature range of 300° C. to 500° C. at a cooling rate of 10 to 80° C./s, and held in the temperature range for 100 to 1000 seconds.

4. The method for producing a high-strength steel sheet according to claim 3, wherein a zinc-based coating treatment is performed after the third heat treatment.

* * * * *